US006422893B1

(12) United States Patent
Caldwell

(10) Patent No.: US 6,422,893 B1
(45) Date of Patent: Jul. 23, 2002

(54) ELECTRICAL CONNECTOR AND CABLE

(75) Inventor: Barry Caldwell, Hesston, KS (US)

(73) Assignee: LSI Logic Corporation, Milpitas, CA (US)

( * ) Notice: Subject to any disclaimer, the term of this patent is extended or adjusted under 35 U.S.C. 154(b) by 0 days.

(21) Appl. No.: 09/641,736

(22) Filed: Aug. 18, 2000

(51) Int. Cl.[7] ..... H01R 4/24
(52) U.S. Cl. ..... 439/425; 174/117 FF
(58) Field of Search ..... 439/425, 389, 439/391, 393, 395, 396, 397, 426, 492, 494, 497, 499; 174/117 FF, 117 F, 32

(56) References Cited

U.S. PATENT DOCUMENTS

| | | | | | |
|---|---|---|---|---|---|
| 1,853,677 | A | | 4/1932 | Fischer | 174/32 |
| 2,376,307 | A | | 5/1945 | Bosch | 174/117 FF |
| 3,964,816 | A | * | 6/1976 | Narozny | 439/397 |
| 4,533,200 | A | * | 8/1985 | Wilson | 439/395 |
| 4,692,566 | A | | 9/1987 | Kauffman | 174/117 FF |
| 4,713,025 | A | * | 12/1987 | Soma | 439/752 |
| 5,059,137 | A | * | 10/1991 | Dale et al. | 439/395 |
| 5,091,610 | A | * | 2/1992 | Strauss | 174/117 F |
| 5,854,445 | A | | 12/1998 | Graham et al. | 174/99 B |
| 6,132,236 | A | * | 10/2000 | Kozel et al. | 439/395 |

* cited by examiner

*Primary Examiner*—Tulsidas Patel
(74) *Attorney, Agent, or Firm*—Suiter & Associates P.C.

(57) ABSTRACT

The present invention is directed to an electrical connector including a first connector pin suitable for making contact on a side of a first flat conductor surrounded by an insulator and a second connector pin suitable for making contact on a side of a second flat conductor surrounded by an insulator. The first flat conductor and the second flat conductor are spaced to form an electrical differential pair.

13 Claims, 5 Drawing Sheets

ELECTRICAL CONNECTOR AND CABLE

FIELD OF THE INVENTION

The present invention generally relates to the field of connectors, and particularly to electrical connectors.

BACKGROUND OF THE INVENTION

Data transmission is one of the most important aspects in modern life. With the increase in processor speeds and devices that are able to perform their functions in an increasingly faster manner, the transmission of the resulting information must be transmitted even faster to realize these advances. For example, currently, round wire conductor (RWC) is used which does not allow the density needed for very high-density cable interconnect (VHDCI) and other very high density connects on cabling for I/O data applications. This is because center to center spacing and wire size plus impedance controls are currently being utilized at the limit of practical usage in a commercial environment.

Further, current connectors using insulation displacement, such as an insulation displacement connector (IDC), do not apply in or are used with a vertically paired flat conductor ribbon cable. Thus, connectors are limited to the old methods of center to center spacing, which can not achieve the connector IDC density needed for connector spacing in the middle of ribbon cable connectors. For example, utilizing previous methods 0.8 mm connector spacing in the middle of ribbon cable connectors was not achievable. Therefore, there exists a need for an easy to use electrical connector suitable for providing increased connector density.

SUMMARY OF THE INVENTION

Accordingly, the present invention is directed to an electrical connector. In a first aspect of the present invention, an electrical connector includes an array of connector pins. At least one connector pin of the array of pins includes a tip suitable for slicing through insulation covering a flat conductor of an electrical cable, thereby enabling the connector pin to contact the flat conductor of the electrical cable.

In a second aspect of the present invention, an electrical connector includes a connector pin suitable for making contact on a side of at least one of a first flat conductor surrounded by an insulator and a second flat conductor surrounded by an insulator. The first flat conductor and the second flat conductor are spaced to form an electrical differential pair.

In a third aspect of the present invention, an electrical connector suitable for use with an electrical cable includes a connector pin suitable for making contact with at least one of a first pair of electrical conductor and a second pair of electrical conductors. A first pair of electrical conductors include a first flat conductor surrounded by an insulator and a second flat conduct surrounded by an insulator, wherein the first flat conductor and the second flat conductor are spaced to form an electrical differential pair. A second pair of electrical conductors includes a third flat conductor surrounded by an insulator and a fourth flat conductor surrounded by an insulator. The third flat conductor and the forth flat conductor are spaced to form an electrical differential pair. A spacer is disposed between the first pair of electrical conductors and the second pair of electrical conductors, the spacer is formed to isolate an electromagnetic field from the first pair of electrical conductors from an electromagnetic field from the second pair of electrical conductors.

It is to be understood that both the forgoing general description and the following detailed description are exemplary and explanatory only and are not restrictive of the invention as claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Reference will now be made in detail to the presently preferred embodiments of the invention, examples of which are illustrated in the accompanying drawings.

Figure 1:
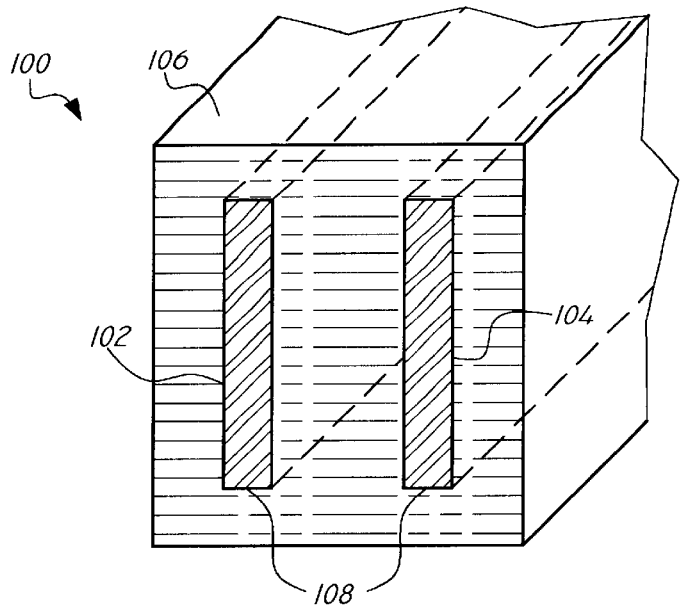
FIG. 1 is an illustration of an exemplary embodiment wherein two conductors are paired together to create an electrical pair of flat conductors.

Referring now to FIG. 1, an exemplary embodiment of the present invention is shown wherein two conductors are paired together to create an electrical pair of flat conductors. A cable 100 includes a first vertical flat conductor 102 and a second vertical flat conductor 104. Preferably, the first vertical flat conductor 102 and the second vertical flat conductor 104 are formed out of copper or another material that is electrically conductive. An insulator 106 is formed so as to surround the first vertical flat conductor 102 and the second flat conduct 104.

Preferable, the first vertical flat conductor 102 and the second vertical flat conductor 104 are paired together to create an electrical pair of vertical flat conductors with a spacing geometry 108 to create an effective electrical differential pair. For example, a signal may be carried on both the first vertical flat conductor 102 and the second vertical flat conductor 104. The voltage on these two conductors may then be utilized to determine whether the signal is a logical one, or a logical zero. By using both the first vertical flat conductor 102 and the second vertical flat conductor 104 to carry a differential signal, interference may be greatly reduced by spacing the first vertical flat conductor 102 and the second vertical flat conductor 104 so that interference signals are common to both conductors, and therefore cancel out.

Preferable, the insulator 106, first vertical flat conductor 102 and second flat conduct 104 are fabricated from a material that provides both the desired respective electrical properties, for example conductivity, dielectric insulation, and the like, and desired respective physical properties such as flexibility such that cable 100 is at least a partially flexible structure. Vertical flat conductors are desirable because they easier to control both the width and depth of material of the conductor as well as the spacing between the conductors. Thus, the capacitance, cross talk, conductance, impedance and DC resistance may be more easily controlled as desired by a user. Additionally, the electrical cable may be formed using extrusion technology, thereby enabling the cable to be produced in a time efficient and cost-effective manner.

Figure 2:
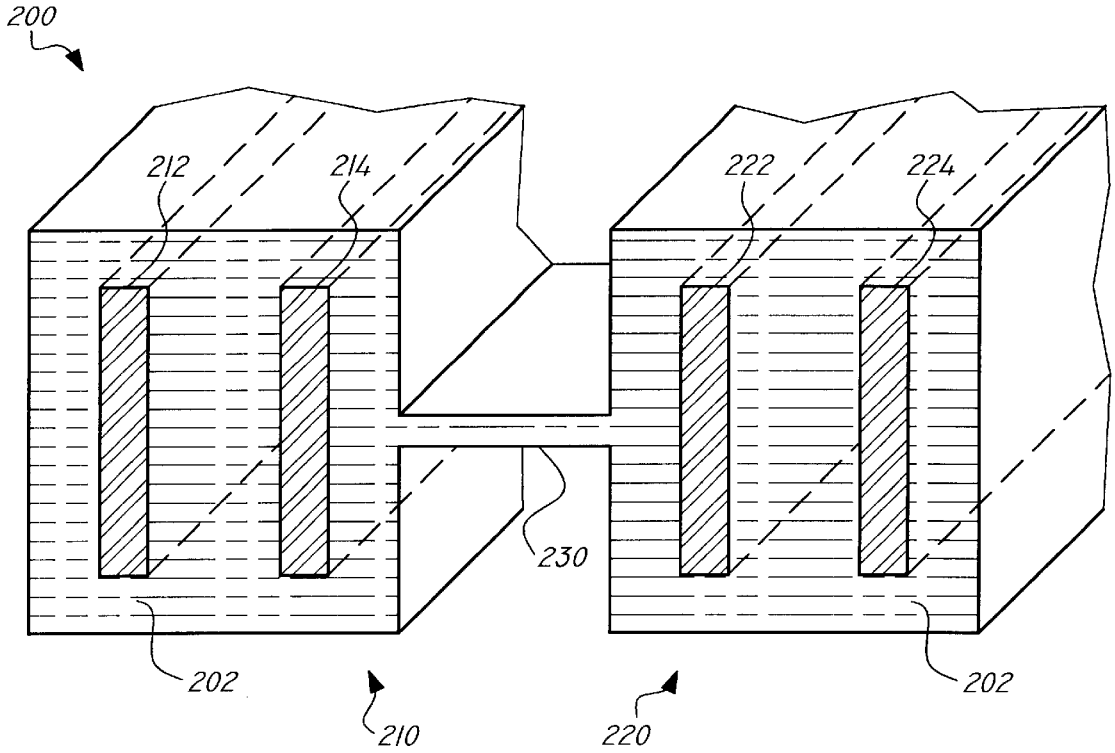
FIG. 2 is an illustration of an exemplary embodiment of the present invention wherein a first pair of conductors and a second pair of conductors are constructed utilizing a spacer so that the first pair of conductors and the second pair of conductors are at an isolated electromagnetic distance.

Referring now to FIG. 2, an exemplary embodiment of the present invention is shown wherein a first pair of conductors and a second pair of conductors are constructed utilizing a spacer so that the first pair of conductors and the second pair of conductors can be made to be at an isolated electrical and electromagnetic distance. A cable 200 includes a first pair of electrical conductors 210 and a second pair of electrical conductors 220. The first pair of conductors 210 may include a first conductor 212 and a second conductor 214 so as to create an effective electrical differential pair, for instance, suitable for operating in an even or odd mode. Likewise, the second pair of conductors 220 may include a first conductor 222 and a second conductor 224 to create an electrical differential pair. An insulator 202 may be formed to surround the electrical conductors 212, 214, 222 and 224. Thus, the present invention may provide a differential vertically paired flat conductor cable (FCC) and a high-density controlled impedance differential paired cable for use with low voltage differential signals (LVDS) in I/O data applications.

Additionally, a spacer 230 may be included between the first pair of electrical conductors 210 and the second pair of electrical conductors 220. Preferable, the spacer 230 is formed so as to isolate the first pair of electrical conductors 210 from the second pair of electrical conductors 220 electromagnetic field. For example, the spacer 230 may separate the pairs at an isolated electromagnetic distance. Thus, it is possible to more closely control the electrical and magnetic parameters that influence high speed signal quality in "ribbon cable". In this way, the electromagnetic envelope of the signaling environment may be controlled. In one embodiment, the electrical conductors 212, 214, 222 and 224 are flat conductors formed in generally rectangular shapes and positioned vertically to each other. For instance, the electrical conductors may be positioned orthogonal to the plane of the cable. Each pair of electrical conductors 210 and 220 include two electrical conductors 212, 214 and 222, 224 oriented generally parallel to each other. The spacer 230 may be formed at a midpoint of the connector so as to impart a generally "H" structure to the first pair of electrical conductors 210—spacer 230—second pair of electrical conductors 220 arrangement. Additionally, the "H" structure also allows a connector construct/design with insulation displacement cabling formats for connector attachment in the "middle" of the cable, instead of just at the end.

Figure 3:
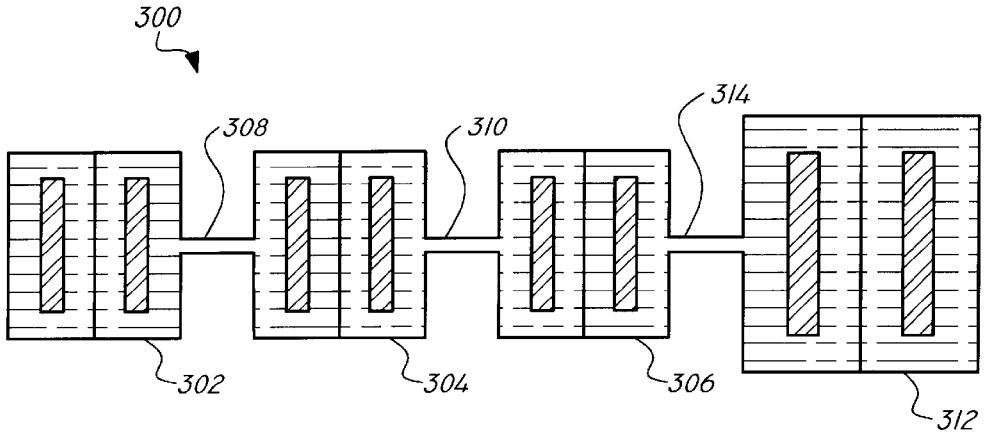
FIG. 3 is an illustration of an exemplary embodiment of the present invention wherein multiple pairs of electrical conductors are utilized to form a ribbon cable.

Referring now to FIG. 3, an exemplary embodiment of the present invention is shown wherein multiple pairs of electrical conductors are utilized to form a ribbon cable. A first pair of electrical conductors 302, a second pair of electrical conductors 304, and a third pair of electrical conductors 306 may be spaced with the use of spacers 308 and 310 disposed between the electrical conductors 302, 304 and 306. The spacing distance may be varied depending on the desired properties of the corresponding electromagnetic envelope formed by the respective conductors. For example, the interference between the second pair of electrical conductors 304 and the third pair of electrical conductors 306 may be less than the interference between the third pair of electrical conductors 306 and a fourth pair of electrical conductors 312. Therefore, a spacer 314 resulting in a greater length between conductors may be utilized between the third pair of electrical conductors 306 and the fourth pair of electrical conductors 312 than the spacer utilized between the second pair of electrical conductors 304 and the third pair of electrical conductors 306.

It should be noted that a cable 300 may be varied to include a number of conductors depending upon the number of conductive paths required for the particular application of cable 300. For instance, a variety of standards may utilize the present invention. For example, in one embodiment contemplated by the present invention, cable 300 may be compliant with a small computer system interface (SCSI) standard, such as SCSI parallel interface (SPI-4), integrated device electronics (IDE), advanced technology attachment (ATA), insulation displacement cable (IDC), insulation displacement termination (IDT), Ultra2, intelligent peripheral interface (IPI), high performance parallel interface (HIPPI), very high density cable interconnect (VHDCI) standard, and the like standard as contemplated by a person of ordinary skill in the art without departing from the spirit and scope of the present invention. For instance, in one embodiment, the cable is compliant with a very high density cable interconnect (VHDCI) standard, and is suitable for employing an insulation displacement cable (IDC) type connector. In another embodiment, the cable is compliant with the SPI-4 standard.

Figure 4:
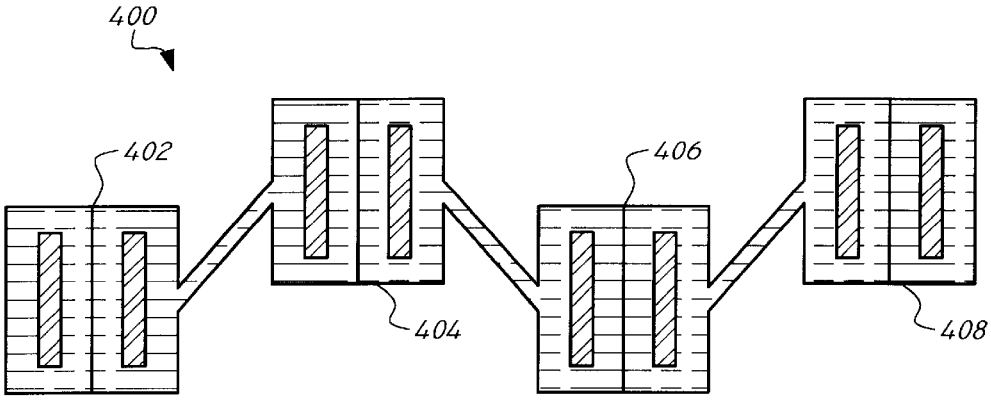
FIG. 4 is an illustration of an exemplary embodiment of the present invention wherein a cable includes staggered pairs of electrical conductors.

Referring now to FIG. 4, an exemplary embodiment of the present invention is shown wherein a cable includes staggered pairs of electrical conductors. A cable 400 may include pairs of electrical conductors 402, 404, 406 and 408 that are staggered. Staggering may provide room for displacement of insulation when utilizing a connector and also provide electromagnetic isolation. The pairs may be non-electrically bonded together for control of mechanical strength and electromagnetic properties, such as impedance, capacitance, inductance, and the like. Additionally, the electrical cable may be formed using extrusion technology, thereby enabling the cable to be produced in a time efficient and cost-effective manner.

Figure 5:
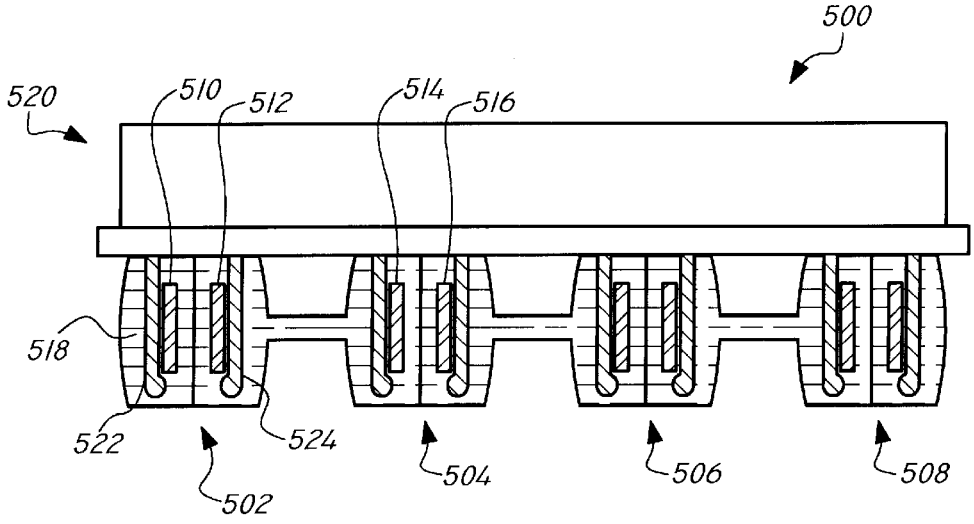
FIG. 5 is an illustration of an exemplary embodiment of the present invention wherein a connector suitable for middle of a ribbon cable attachment is shown.

Referring now to FIG. 5, an exemplary embodiment of the present invention is shown wherein an electrical connector is suitable for middle of the cable attachment. A cable 500 includes a first pair of electrical conductors 502, a second pair of electrical conductors 504, a third pair of electrical conductors 506 and a fourth pair of electrical conductors 508. The first pair of conductors 502 includes a first conductor 510 and a second conductor 512. Likewise, the second pair of conductors 504 includes a first conductor 514 and a second conductor 516. An insulator 518 is formed to surround the electrical conductors 510, 512, 514, and 516. Thus, the present invention may provide a differential vertically paired vertical flat conductor cable (FCC) and a high density controlled impedance differential paired cable for use with low voltage differential signals (LVDS) in I/O data applications.

A connector 520 may include an insulation displacement connector (IDC) pin pair 522 and 524 suitable for connection to the cable 500. The insulation displacement connector (IDC) pin pair 522 and 524 are suitable for slicing through the insulation 518 on the sides of the first pair of electrical conductors 502. Preferably, the insulation displacement connector (IDC) pins 522 and 524 are formed of gold or some other conductive material. For example, pins may be formed out of steel or copper alloys with a nickel then gold over plate. The contact fingers as used on a printed circuit board tongue plug connect may be made with an electro-plate of copper substrate of several 100 micro inches thickness generally with an over plating of nickel, such as 30 micro inches, then gold of 3 to 30 micro inches of electronic grade gold plate.

The connector 520 is constructed in such a manner as to apply continuous mechanical and electrical contact to the flat conductor metal, such as the first pair of electrical conductors 502, after insertion through the cable 500. The connector 520 may extend up into a connector housing to create a plug and receptacle connection interface, such as in a pin to pin champ style wiper, plated pad connection, and the like. Thus, the present invention may provide an easy to use differential vertically paired wiper insulation displacement connector (IDC) for high-density cable-connector assemblies, such as a high density controlled impedance differential paired connect wiper insulation displacement connector structure for use with a vertical paired flat conductor ribbon cable for use with differential or signal ended or LVDS signals in data I/O applications. Further, this process may allow decreasing the density below 0.8 mm with good results both mechanically and electrically.

Although a flat ribbon cable is described, it should be apparent that a connector of the present invention may also be configured to couple to an offset cable without departing from the spirit and scope of the present invention. For example, an offset cable, as shown in FIG. 4, may be preferable to further increase the density of the cable. By going to paired wiper insulation displacement connector (IDC) pins that are constructed in pairs and constructed in an offset manner in the cable side of the connector very high-density middle of the cable insertion of a connector is possible. This will also allow better impedance, capacitance and inductance control in constructing the plug or receptacle portion of the connector/cable. Further, it should make it possible to closely control the electrical and magnetic parameters that influence high speed signal quality in "ribbon cable" connector interconnect, such as used in Ultra 2 and beyond SCSI along with IPI, HIPPI, and the like. This will also make connector design and construction of higher densities possible.

Figure 6A:
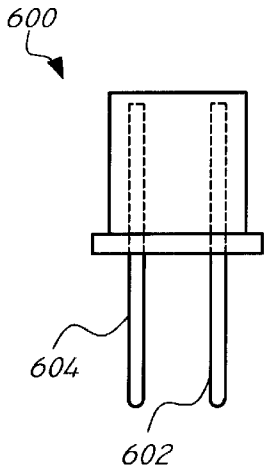
FIG. 6A is an end view of an exemplary connector of the present invention wherein connectors are arranged in multiple planes.
Figure 6B:
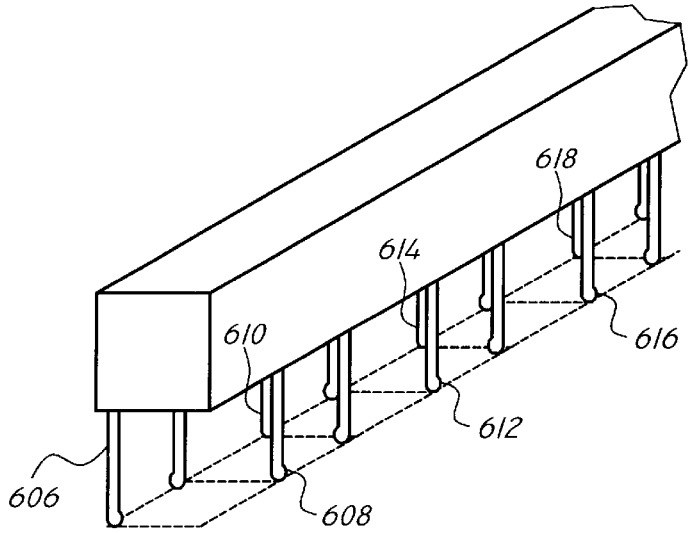
FIG. 6B is an isometric of the exemplary connector shown in FIG. 6A further depicting a staggered offset configuration.

Referring now to FIGS. 6A and 6B, an exemplary embodiment of the present invention is shown wherein a connector includes staggered offset insulation displacement pin pairs. Some connector styles utilize a staggered device connection pin placement for connection to devices. To conform to such a connector style, pin pairs may be arranged in multiple rows, such as a first row 602 and a second row 604 shown in the end view of a connector in FIG. 6A. Additionally, the connector pairs may be offset, as shown in FIG. 6B. In this example, pairs 606, 608, 610, 612, 614, 616 and 618 are shown in a staggered offset manner. Thus, sequential cable wire pairs will correctly line up with the insulation displacement pair across the cable on a double-sided plug structure. Preferably, the offsets are spaced to allow appropriate plug gold finger spacing of the connector, for example, to connect to another device, and insulation displacement pin spacing for strength and ease of assembly to match dimensional needs. For example, a VHDCI plug connector used with a "CHAMP" style receptacle connector may include a double-sided plug board that would greatly benefit from the use of a staggered offset. Further, the length of the connector pins may be staggered and offset to further arrive at increased connector density. For example, a first connector pin may have a different length than a second connector pin, either within a pair or between pairs as contemplated by a person of ordinary skill in the art.

Figure 7A:
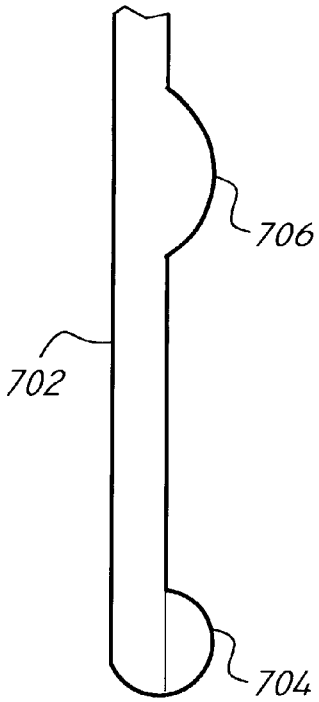
FIG. 7A is a detailed side view of an exemplary connector pin of the present invention.
Figure 7B:
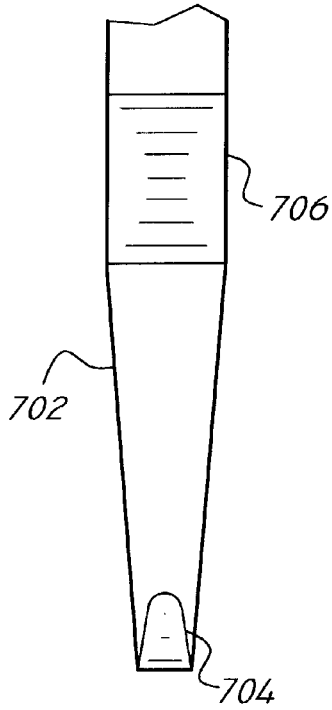
FIG. 7B is a detailed edge view of the exemplary connector pin shown in FIG. 7A.
Figure 7C:
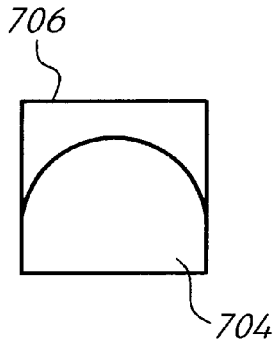
FIG. 7C is an end view of the exemplary connector pin shown in FIGS. 7A and 7B.

Referring now to FIGS. 7A, 7B and 7C, detailed views of an exemplary insulation displacement pins are shown. As shown in FIGS. 7A and 7B, a side view of an insulation displacement pin 702 illustrates a beveled, rounded edge tip 704 which protrudes slightly beyond the body of the pin 702. The beveled edge tip 704 enables the pin 702 to slice through the insulation covering the conductor in a vertical conductor cable without cutting the conductor. Additionally, a bulge 706 may be included above the beveled edge tip 704 to provide a mechanical pressure point to apply electrical contact to the electrical conductor in a cable after the insulation is displaced by the pin 702. Additionally, the connector may be formed wherein the pin 702 and bulge 706 have a generally rectangular shape with a beveled, rounded edge tip 704, as shown in the end view of the connector pin in FIG. 7C.

Figure 8A:
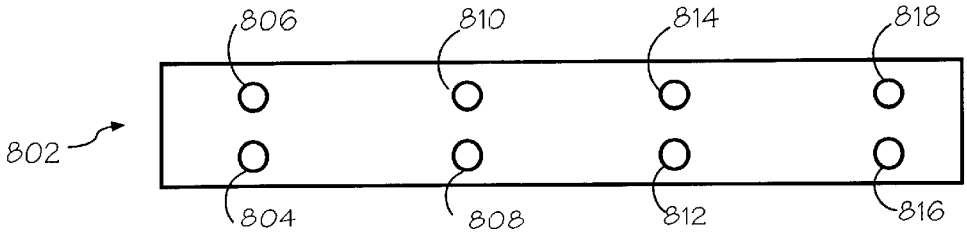
FIG. 8A is an exemplary connector arrangement.
Figure 8B:
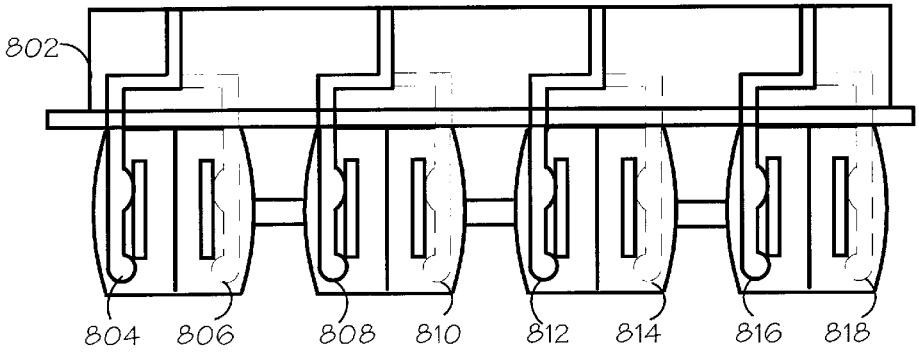
FIG. 8B is a side view of a connector suitable for providing the exemplary connector arrangement as shown in FIG. 8A.
Figure 8C:
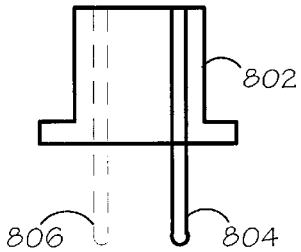
FIG. 8C is an end view of the exemplary connector of the present invention shown in FIGS. 8A and 8B.

Referring now to FIGS. 8A, 8B and 8C, an exemplary embodiment of the present invention is shown wherein a male pin style connector utilizing insulation displacement pin pairs have an offset within the pair. A connector 802 may utilize sequentially spaced pairs of connector pins 804, 806, 808, 810, 812, 814, 816 and 818, as shown in FIG. 8A. To provide such a connector arrangement, an offset is configured within each pair of connector pins, such as connector pins 804 and 806 shown in FIG. 8B. Thus, a first row of connector pins 804, 808, 812 and 816 may be positioned in a plane forward of a second row of connector pins 806, 810, 814 and 818. An end view of connector 802 shown in FIG. 8C further illustrates the position of connector pin 804 in relation to connector pin 806 to provide the desired arrangement. Thus, a cable utilizing the present invention may have more structural integrity by alternating the penetration point of the connector pin. Although use of an offset and stagger has been described, it should be apparent that a connector may be configured without an offset and/or stagger without departing from the spirit and scope of the present invention.

It is believed that the electrical cable of the present invention and many of its attendant advantages will be understood by the forgoing description. It is also believed that it will be apparent that various changes may be made in the form, construction and arrangement of the components thereof without departing from the scope and spirit of the invention or without sacrificing all of its material advantages. The form herein before described being merely an explanatory embodiment thereof. It is the intention of the following claims to encompass and include such changes.

What is claimed is:

1. An electrical connector suitable for use with an electrical cable, comprising:

a connector pin suitable for making contact with at least one of a first pair of electrical conductors, including a first flat conductor surrounded by an insulator;

a second flat conductor surrounded by an insulator, wherein the first flat conductor and the second flat conductor are spaced so as to form an electrical differential pair; and a second pair of electrical conductors, including a third flat conductor surrounded by an insulator;

a fourth flat conductor surrounded by an insulator, wherein the third flat conductor and the fourth flat conductor are spaced so as to form an electrical differential pair;

a spacer is disposed between the first pair of electrical conductors and the second pair of electrical conductors, the spacer formed so as to isolate an electromagnetic field from the first pair of electrical conductors from an electromagnetic field from the second pair of electrical conductors wherein the connector pin includes at least one of:

a tip, the tip including a beveled and rounded edge, the beveled and rounded edge protruding at least partially beyond the body of the connector pin; and a bulge located above the tip, the bulge suitable for providing a mechanical pressure point to apply electrical contact to the conductor in a cable after insulation is displaced by the connector pin.

2. The electrical connector as described in claim 1, wherein at least one of the first pair of electrical conductors and the second pair of electrical conductors is oriented vertically.

3. The electrical connector as described in claim 1, further comprising a first pair of connector pins and a second pair of connector pins, the first pair of connector pins being offset from the second pair of connector pins.

4. The electrical connector as described in claim 1, further comprising a pair of connector pins having a first connector pin and a second connector pin, the first connector pin being offset from the second connector pin.

5. The electrical connector as described in claim 1, further comprising a first pair of connector pins, a second pair of connector pins and a third pair of connector pins, the first pair of connector pins, the second pair of connector pins and the third pair of connector pins are arranged in a staggered manner.

6. The electrical connector as described in claim 1, further comprising a second connector pin and a third connector pin, wherein the first connector pin, second connector pin and third connector pin are arranged in a staggered manner.

7. An electrical connection, comprising:

an electrical cable having an electrical differential pair, the electrical differential pair including a first flat conductor surrounded by an insulator and a second flat conductor surrounded by an insulator, the first flat conductor and the second flat conductor spaced to form an electrical differential pair; and an electrical connector, comprising:

a first connector pin making contact on a side of the first flat conductor surrounded by the insulator; and a second connector pin making contact on a side of the second flat conductor surrounded by the insulator;

wherein at least one of the first connector pin and the second connector pin includes a tip, the tip including a beveled and rounded edge, the beveled and rounded edge protruding at least partially beyond body of the pin and wherein at least one of the first connector pin and the second connector pin include a bulge located above the tip, the bulge suitable for providing a mechanical pressure point to apply electrical contact to the conductor in a cable after insulation is displaced by the connector pin.

8. The electrical connection as described in claim 7, wherein the first connector pin and the second connector pin are configured to form a first pair of connector pins and further comprising a third connector pin and a fourth connector pin configured to form a second pair of connector pins, the first pair of connector pins being offset from the second pair of connector pins.

9. The electrical connection as described in claim 7, wherein the first connector pin is offset from the second connector pin.

10. The electrical connection as described in claim 7, wherein the first connector pin and the second connector pin are configured to form a first pair of connector pins and further comprising a third connector pin and a fourth connector pin configured to form a second pair of connector pins and a fifth connector pin and a sixth connector pin configured to form a third pair of connector pins, the first pair of connector pins, the second pair of connector pins and the third pair of connector pins being arranged in a staggered manner.

11. The electrical connection as described in claim 7, further comprising a third connector pin, wherein the first connector pin, the second connector pin and the third connector pin are arranged in a staggered manner.

12. The electrical connection as described in claim 7, wherein the first flat conductor and the second flat conductor are vertically oriented.

13. The electrical connection as described in claim 12, wherein the first flat conductor and the second flat conductor each having a first side longer than a second side, wherein the first longer side of the first flat conductor is aligned so as to generally correspond to the first longer side of the second flat conductor.

* * * * *